US008850844B2

(12) United States Patent
Kang et al.

(10) Patent No.: US 8,850,844 B2
(45) Date of Patent: Oct. 7, 2014

(54) COOL AIR SUPPLY STRUCTURE OF STORAGE RECEPTACLE FOR REFRIGERATOR

(75) Inventors: Byeong-Gyu Kang, Gimhae (KR); Young-Woo Kim, Gimhae (KR); Jong-Suk Yoon, Pyeongtaek (KR); Yoon-Seok Bang, Bucheon (KR); Jong-Wook An, Gyeongsangnam-do (KR); Sang-Ho Park, Gimhae (KR)

(73) Assignee: LG Electronics Inc., Seoul (KR)

( * ) Notice: Subject to any disclaimer, the term of this patent is extended or adjusted under 35 U.S.C. 154(b) by 1314 days.

(21) Appl. No.: 12/282,676

(22) PCT Filed: Mar. 13, 2007

(86) PCT No.: PCT/KR2007/001227

§ 371 (c)(1),
(2), (4) Date: Sep. 12, 2008

(87) PCT Pub. No.: WO2007/105902

PCT Pub. Date: Sep. 20, 2007

(65) Prior Publication Data

US 2009/0173100 A1 Jul. 9, 2009

(30) Foreign Application Priority Data

Mar. 13, 2006 (KR) ..... 10-2006-0023222
Mar. 14, 2006 (KR) ..... 10-2006-0023357
Mar. 14, 2006 (KR) ..... 10-2006-0023358

(51) Int. Cl.
*F25D 25/02* (2006.01)
*F25D 17/08* (2006.01)

(52) U.S. Cl.
CPC ..... *F25D 25/025* (2013.01); *F25D 17/08* (2013.01)
USPC ..... 62/382; 62/407

(58) Field of Classification Search
CPC ..... F25D 25/025; F25D 17/08
USPC ..... 62/382, 407, 408, 441, 465, 449; 312/404, 405
See application file for complete search history.

(56) References Cited

U.S. PATENT DOCUMENTS 4,850,206 A * 7/1989 Larsen ..... 62/382
5,212,962 A * 5/1993 Kang et al. ..... 62/382
5,388,427 A * 2/1995 Lee ..... 62/331

(Continued)

FOREIGN PATENT DOCUMENTS

JP 2000-205732 A 7/2000
KR 10-2003-0038997 A 5/2003

(Continued)

*Primary Examiner* — Mohammad M Ali
(74) *Attorney, Agent, or Firm* — Birch, Stewart, Kolasch & Birch, LLP

(57) ABSTRACT

A cool air supply structure of a storage receptacle for a refrigerator, which includes a main body having a storage space provided therein and a door for selectively opening or closing the storage space, the cool air supply structure, comprising: one or more receptacle casings detachably installed into the storage space and having a mounting space provided therein so that a storage receptacle is moved into or out of the mounting space; and a channel provided in each of the receptacle casings so that cool air flows in the channel, wherein food received in the storage receptacle is indirectly cooled by the cool air flowing in the channel. According to the present invention, the food received in the storage receptacle of a refrigerator can be kept fresh with a simple configuration.

28 Claims, 7 Drawing Sheets

(56) References Cited

U.S. PATENT DOCUMENTS

| | | | | |
|---|---|---|---|---|
| 5,392,615 | A * | 2/1995 | Lim | 62/414 |
| 6,170,276 | B1 * | 1/2001 | Mandel et al. | 62/187 |
| 6,223,553 | B1 * | 5/2001 | Albert et al. | 62/407 |
| 6,343,477 | B1 * | 2/2002 | Mandel et al. | 62/187 |
| 6,463,752 | B2 * | 10/2002 | Mandel et al. | 62/382 |
| 6,612,116 | B2 * | 9/2003 | Fu et al. | 62/3.6 |
| 6,637,235 | B2 * | 10/2003 | Sakamoto et al. | 62/443 |

FOREIGN PATENT DOCUMENTS

| | | | |
|---|---|---|---|
| KR | 10-2003-0038999 | A | 5/2003 |
| KR | 10-2003-0039016 | A | 5/2003 |

* cited by examiner

COOL AIR SUPPLY STRUCTURE OF STORAGE RECEPTACLE FOR REFRIGERATOR

TECHNICAL FIELD

The present invention relates to a refrigerator, and more particularly, to a cool air supply structure of a storage receptacle for a refrigerator, which is to supply cool air to a storage receptacle for a refrigerator.

BACKGROUND ART

FIG. 7 is a front view showing an interior of a conventional refrigerator.

As shown in FIG. 7, a refrigerator main body 1 includes a refrigerating chamber 3 and a freezing chamber (not shown), which are partitioned up and down from each other. The refrigerating chamber 3 and the freezing chamber are selectively opened or closed by means of refrigerating chamber doors 5 and 5' and a freezing chamber door 7, respectively. The refrigerating chamber doors 5 and 5' are respectively installed to be pivotable on their one ends so that their leading ends are moved in a fore and aft direction. In addition, the freezing chamber door 7 is configured to selectively open or close the freezing chamber in a drawer fashion.

Meanwhile, a cool air duct 9 is provided at a center of a rear surface of the refrigerating chamber 3. The cool air duct 9 is to supply cool air into the refrigerating chamber 3. To this end, as enlargedly shown in FIG. 7, a plurality of cool air supply holes 9A are provided in the cool air duct 9.

In addition, although not shown, a plurality of cool air return holes are provided in a lower portion of the rear surface of the refrigerating chamber 3. The cool air return holes are to transfer cool air, which has circulated in the refrigerating chamber 3, to a return duct (not shown).

Meanwhile, a plurality of shelves 11 are provided in the refrigerating chamber 3 in order to receive food. The shelves 11 are installed to be detachable into or out of the refrigerating chamber 3. The shelves 11 serve to vertically partition an interior of the refrigerating chamber 3. In addition, food is placed on an upper surface of the shelf 11.

Also, a vegetable receptacle cover 13 is provided in a lower portion of the refrigerating chamber 3. The vegetable receptacle cover 13 is a substantially lowermost shelf among the shelves 11 installed in the refrigerating chamber 3. The refrigerating chamber 3 is partitioned into upper and lower portions by the vegetable receptacle cover 13. At this time, the lower portion of the refrigerating chamber 3 corresponding to a part below the vegetable receptacle cover 13 is referred to as a vegetable chamber, for convenience.

A plurality of vegetable receptacles 15 are installed in the vegetable chamber. The vegetable receptacles 15 are installed to be taken in or out of the vegetable chamber in a drawer fashion. The vegetable receptacle 15 has a receiving space provided therein so that food such as vegetable or fruit can be received in the receiving space. The receiving space of the vegetable receptacle 15 generally has an open upper portion, which is covered with a bottom surface of the vegetable receptacle cover 13 or another vegetable receptacle positioned directly above it.

However, the conventional refrigerator as mentioned above has the following problems.

As explained above, the receiving space of the vegetable receptacle 15 is covered with the bottom surface of the vegetable receptacle cover 13 or another vegetable receptacle positioned directly above it, but this cannot ensure the complete sealing. Thus, the cool air circulating in the refrigerating chamber 3 is transferred to the receiving space of the vegetable receptacle 15 and brought into contact with food such as vegetable or fruit received therein. Accordingly, smell of other food stored in the refrigerating chamber 3 can be soaked into the food received in the receiving space of the vegetable receptacle 13, the food may be weakly cooled or overcooled, or moisture of food is vaporized to make the food dry.

DISCLOSURE

Technical Problem

The present invention is conceived to solve the aforementioned problems in the prior art. An object of the present invention is to provide a cool air supply structure of a storage receptacle for a refrigerator, which is configured to keep food received in the storage receptacle to be fresher.

Another object of the present invention is to provide a cool air supply structure of a storage receptacle for a refrigerator, which is configured to indirectly cooling food received in a storage receptacle with a simpler configuration.

Technical Solution

According to an aspect of the present invention for achieving the objects, there is provided a cool air supply structure of a storage receptacle for a refrigerator, which includes a main body having a storage space provided therein and a door for selectively opening or closing the storage space, the cool air supply structure, comprising one or more receptacle casings detachably installed into the storage space and having a mounting space provided therein so that a storage receptacle is moved into or out of the mounting space; and a channel provided in each of the receptacle casings so that cool air flows in the channel, wherein food received in the storage receptacle is indirectly cooled by the cool air flowing in the channel.

According to other aspect of present invention, there is provided a cool air supply structure of a storage receptacle for a refrigerator, which includes a main body having a storage space provided therein and a door for selectively opening or closing the storage space, the cool air supply structure, comprising one or more receptacle casings detachably installed into the storage space and having a mounting space provided therein; a channel provided in each of the receptacle casings so that cool air flows in the channel; and a storage receptacle installed into the mounting space to be moved into or out of the mounting space, the storage receptacle having a receiving space defined therein to store food, wherein food received in the storage receptacle is indirectly cooled by the cool air flowing in the channel.

Among a freezing chamber and a refrigerating chamber that the storage space includes, the receptacle casings are detachably installed into the refrigerating chamber.

The cool air in the refrigerating chamber is transferred to the channel through a cool air duct installed to a center of a rear surface of the refrigerating chamber, and the one or more receptacle casings is installed in the refrigerating chamber.

The receptacle casings are provided in a pair to stand side by side in the refrigerating chamber.

The cool air flowing in the channel is introduced through a cool air inlet provided in a rear surface of the receptacle casing to communicate with any one of cool air supply holes of the cool air duct; and the cool air flowing in the channel to indirectly cool the food received in the receiving space is discharged to the refrigerating chamber through a cool air outlet provided in the rear surface of the receptacle casing.

According to the other aspect of the present invention, there is provided a cool air supply structure of a storage receptacle for a refrigerator, which includes a main body having a storage space provided therein, the storage space including a freezing chamber and a refrigerating chamber, and a door for selectively opening or closing the storage space, the cool air supply structure, comprising a cool air duct provided in a center of a rear surface of the refrigerating chamber to transfer cool air of the freezing chamber to the refrigerating chamber, the cool air duct including one or more cool air supply holes functioning as an inlet for transferring cool the air of the freezing chamber to the refrigerating chamber; one or more receptacle casings installed in a pair to stand side by side in the refrigerating chamber, each of the receptacle casings having a mounting space provided therein; a channel provided in each of the receptacle casings so that cool air transferred through any one of the cool air supply holes flows in the channel; and a storage receptacle installed into the mounting space to be moved into or out of the mounting space, the storage receptacle having a receiving space defined therein to store food, wherein the food received in the storage receptacle is indirectly cooled by the cool air flowing in the channel.

The support ribs are respectively provided on top ends of both sides of the receptacle casing, the support ribs being slidably supported along rails provided on both side surfaces of the storage space.

The rails includes casing support rails provided on a center of a bottom surface of a shelf detachably installed to be moved into or out of the storage space; casing support rails provided on both the side surfaces of the storage space; and auxiliary rails provided on both side ends of the bottom surface of the shelf at the same level as the casing support rails of the storage space to extend the casing support rail of the storage space.

The cool air supply structure further comprise a fixing means for fixing the receptacle casing to prevent the receptacle casing from being detached inadvertently in a state where the receptacle casing is mounted into the storage space.

The fixing means includes a fixing protrusion provided on any one of the casing support rail and the receptacle casing, and a fixing opening provided in the other one of the casing support rail and the receptacle casing; and the fixing protrusion is inserted into the fixing opening, whereby the receptacle casing is fixed in a state where the receptacle casing is received in the storage space.

The cool air supply structure further comprise a cool air guide for guiding the cool air flowing in the channel.

The cool air guide guides the cool air introduced into the channel to flow in a front end portion of the channel and be discharged out of the channel.

The cool air guide extends toward the outside of the channel to pass through a cool air inlet and a cool air outlet provided in the rear surface of the receptacle casing.

The receptacle casing includes a lower casing formed in the shape of a heptahedron with a front face and an upper portion opened, an upper casing formed in the shape of a hexahedron with a lower portion opened and fixed to a top end of the lower casing, and an inner plate fixed to an interior of the lower casing corresponding to a lower portion of the upper casing; and the channel is defined by an upper surface and both side surfaces of the upper casing and an upper surface of the inner plate.

The cool air supply structure further comprise a cool air guide for guiding the cool air flowing in the channel.

The cool air guide is formed integrally with the upper surface of the inner plate, whereby a top end of the cool air guide is brought into contact with an inside upper surface of the upper casing.

The cool air guide guides the cool air introduced into the channel to flow in a front end portion of the channel and then to be discharged out of the channel.

The cool air guide extends to pass through a cool air inlet and a cool air outlet provided in the rear surface of the receptacle casing.

At least one catching slot is provided in any one of the lower casing and the upper casing; at least one catching protrusion is provided on the other one of the lower casing and the upper casing; and the catching protrusion is inserted into the catching slot in a state where the upper casing is placed on the top end of the lower casing, whereby the lower casing and the upper casing are fixed to each other.

The catching slot is formed by cutting a portion of at least one guide protrusion provided on the top end of the lower casing to be opened rearwards; and the catching protrusion extends outward from each of both side ends of the upper casing.

The insertion slots are respectively provided in top ends of both inner sides of the lower casing to extend in a fore and aft direction; and both side ends of the inner plate are inserted into the insertion slots, whereby the lower casing and the inner plate are fixed to each other.

The cool air supply structure further comprise a guide means for guiding the storage receptacle that is moved into or out of the mounting space.

The guide means includes support rollers respectively provided at front ends of both inner sides of the receptacle casing to guide movement of guide ribs provided on both outer side surfaces of the storage receptacle while the storage receptacle is moved into or out of the mounting space, and guide rails respectively provided on both inner side surfaces of the receptacle casing at positions corresponding to rears of the support rollers so that the guide ribs guided by means of the support rollers slide thereon.

The guide rails includes upper guide rails horizontally extending on both the inner side surfaces of the receptacle casing; and lower guide rails horizontally extending on both the inner side surfaces of the receptacle casing to be downwardly spaced apart from bottom surfaces of the upper guide rails.

The guide rail further includes an inclined guide section extending forward from a leading end of the upper guide rail to be inclined upward to guide sliding of the guide rib while the storage receptacle is received in the mounting space.

The guide rail further includes at least one reinforcing rib provided on an upper surface of the upper guide rail and a lower surface of the lower guide rail to reinforce the upper and lower guide rails.

Advantageous Effects

According to the present invention, there is an advantage in that food received in a storage receptacle of a refrigerator can be kept fresh with a simple configuration.

BEST MODE

Hereinafter, a cool air supply structure of a storage receptacle for a refrigerator according to a preferred embodiment of the present invention will be described in detail with reference to the accompanying drawings. In this specification, among storage receptacles for a refrigerator, a vegetable receptacle for receiving vegetable or fruit will be particularly explained.

Figure 1:
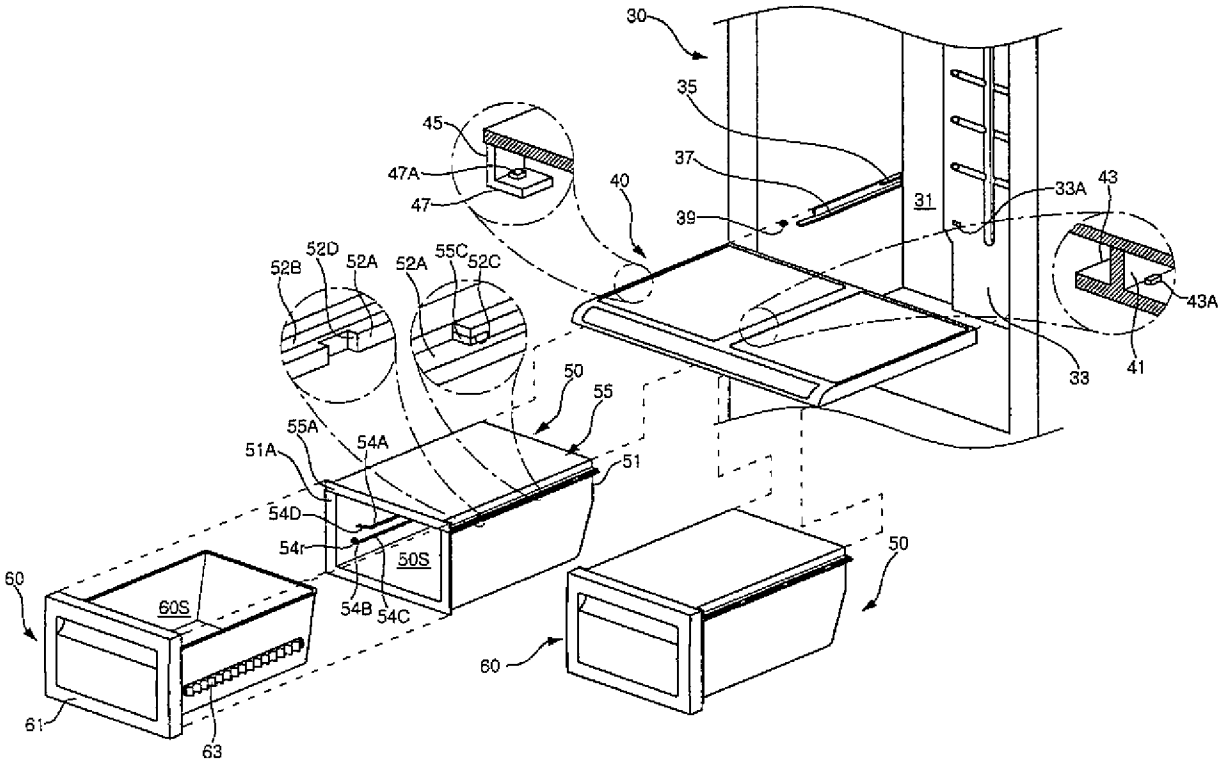
FIG. 1 is an exploded perspective view showing a major portion of a refrigerator provided with a preferred embodiment of a cool air supply structure of a storage receptacle for a refrigerator according to the present invention.
Figure 2:
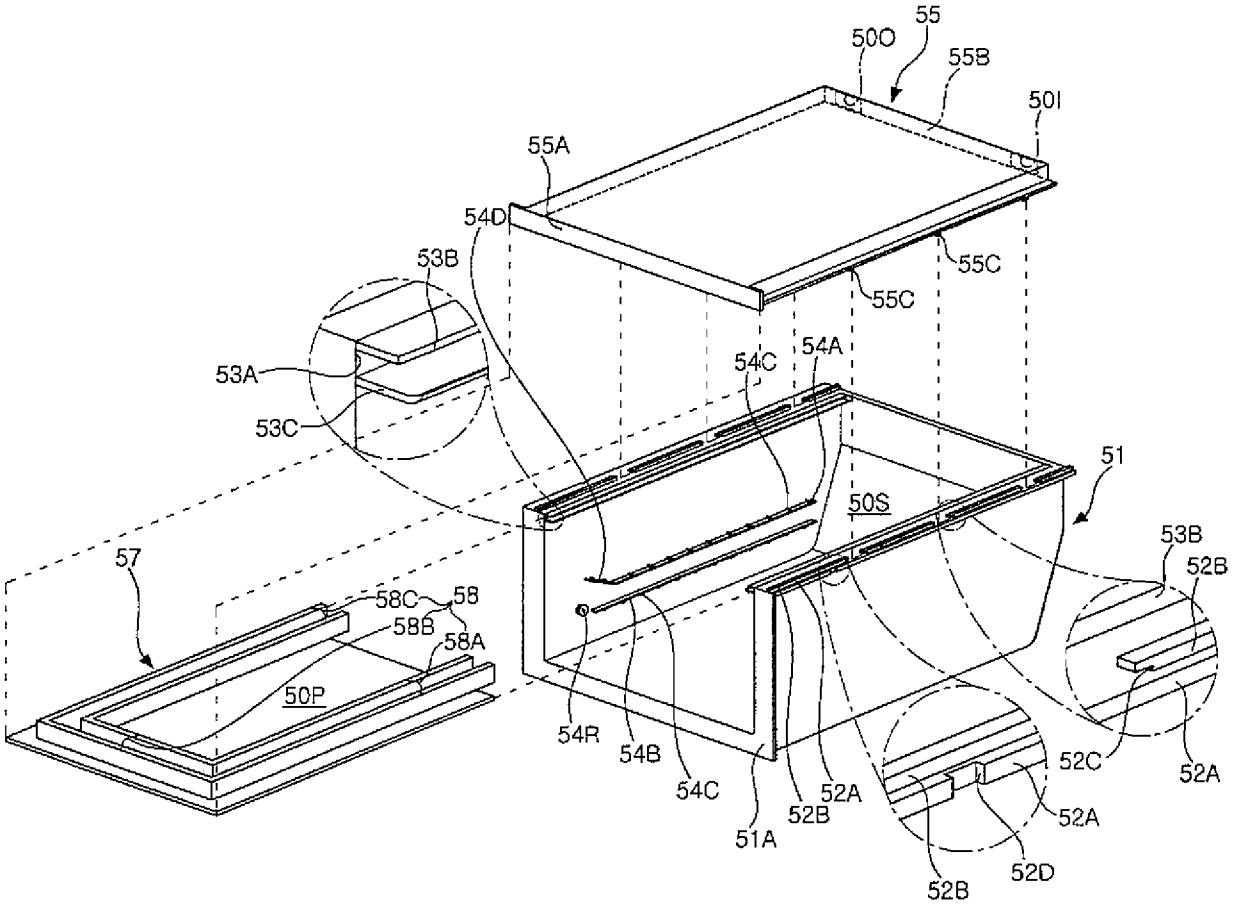
FIG. 2 is an exploded perspective view showing a receptacle casing of the preferred embodiment of the present invention.
Figure 3:
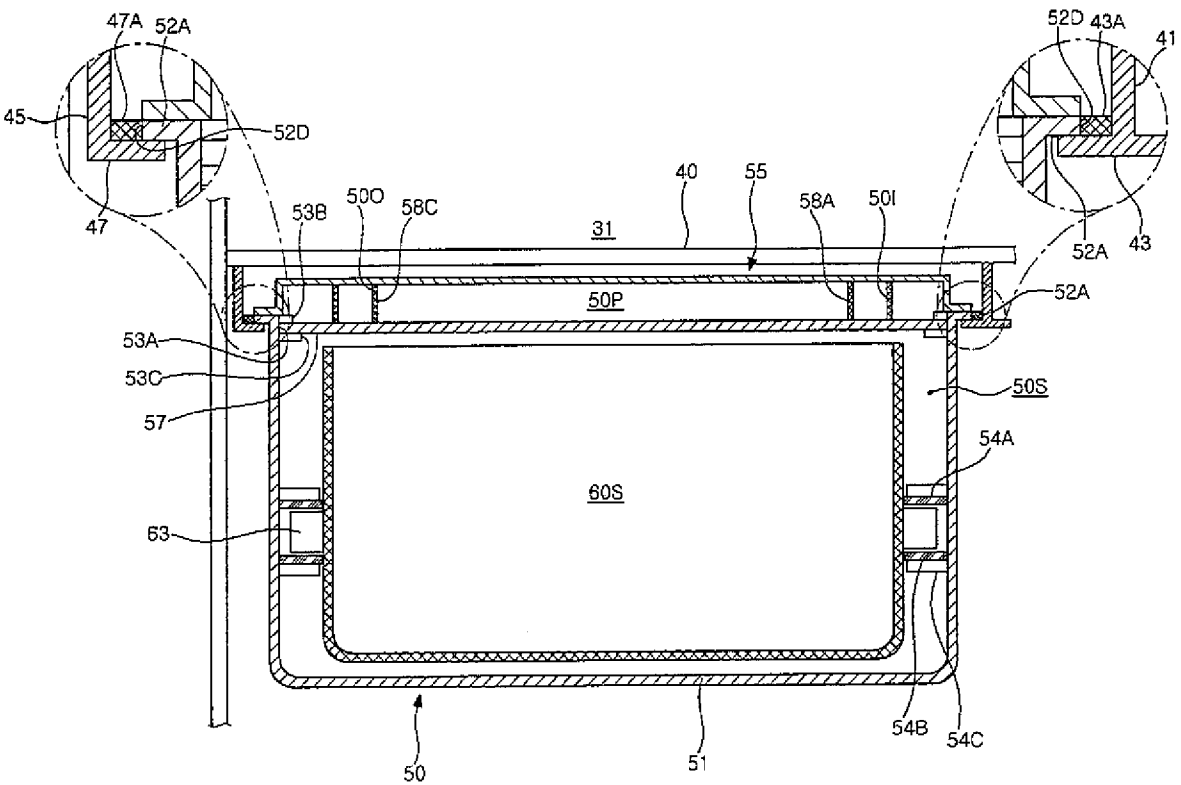
FIGS. 3 and 4 are longitudinal sectional views showing that the storage receptacle is mounted to the receptacle casing according to the preferred embodiment of the present invention.
Figure 4:
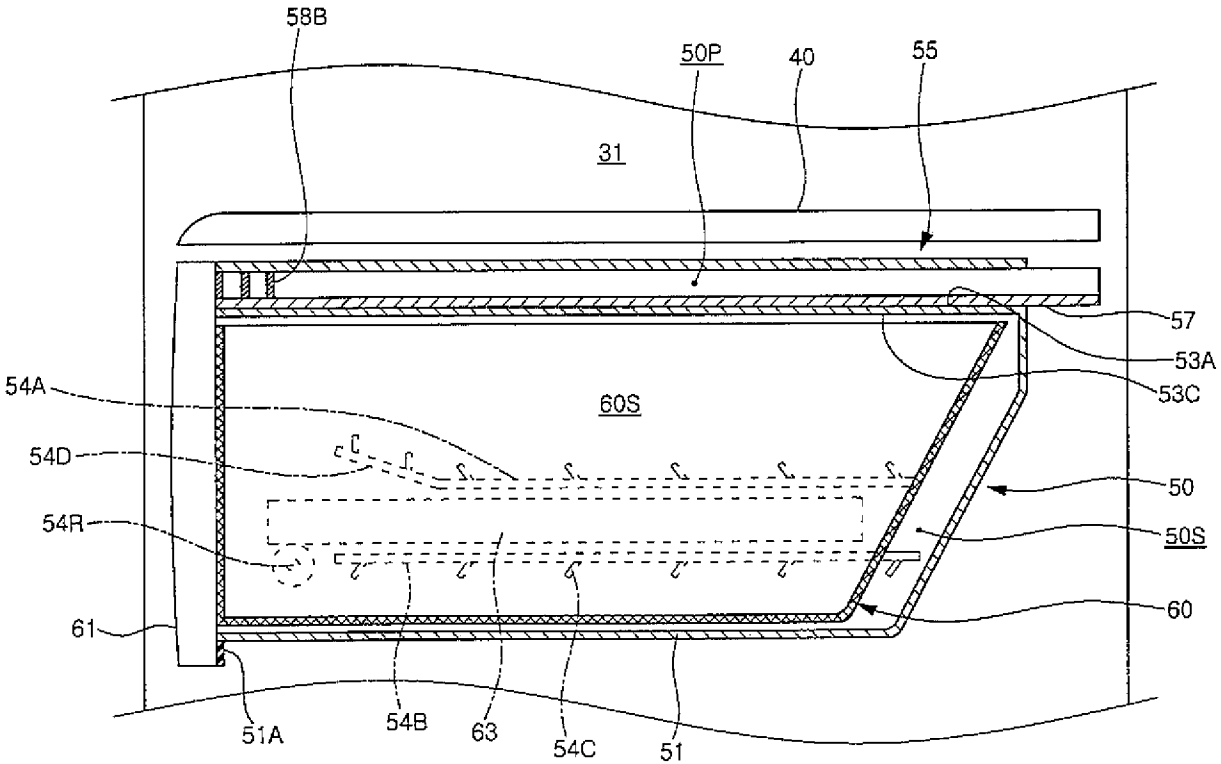

FIG. 1 is an exploded perspective view showing a major portion of a refrigerator provided with a preferred embodiment of a cool air supply structure of a storage receptacle for a refrigerator according to the present invention, FIG. 2 is an exploded perspective view showing a receptacle casing of the preferred embodiment of the present invention, and FIGS. 3 and 4 are longitudinal sectional views showing that the storage receptacle is mounted to the receptacle casing according to the preferred embodiment of the present invention.

As shown in the figures, a refrigerator main body 30 has a predetermined storage space provided therein in order to store food. The storage space of the refrigerator main body 30 is vertically partitioned into a refrigerating chamber 31 and a freezing chamber (not shown).

Figure 7:
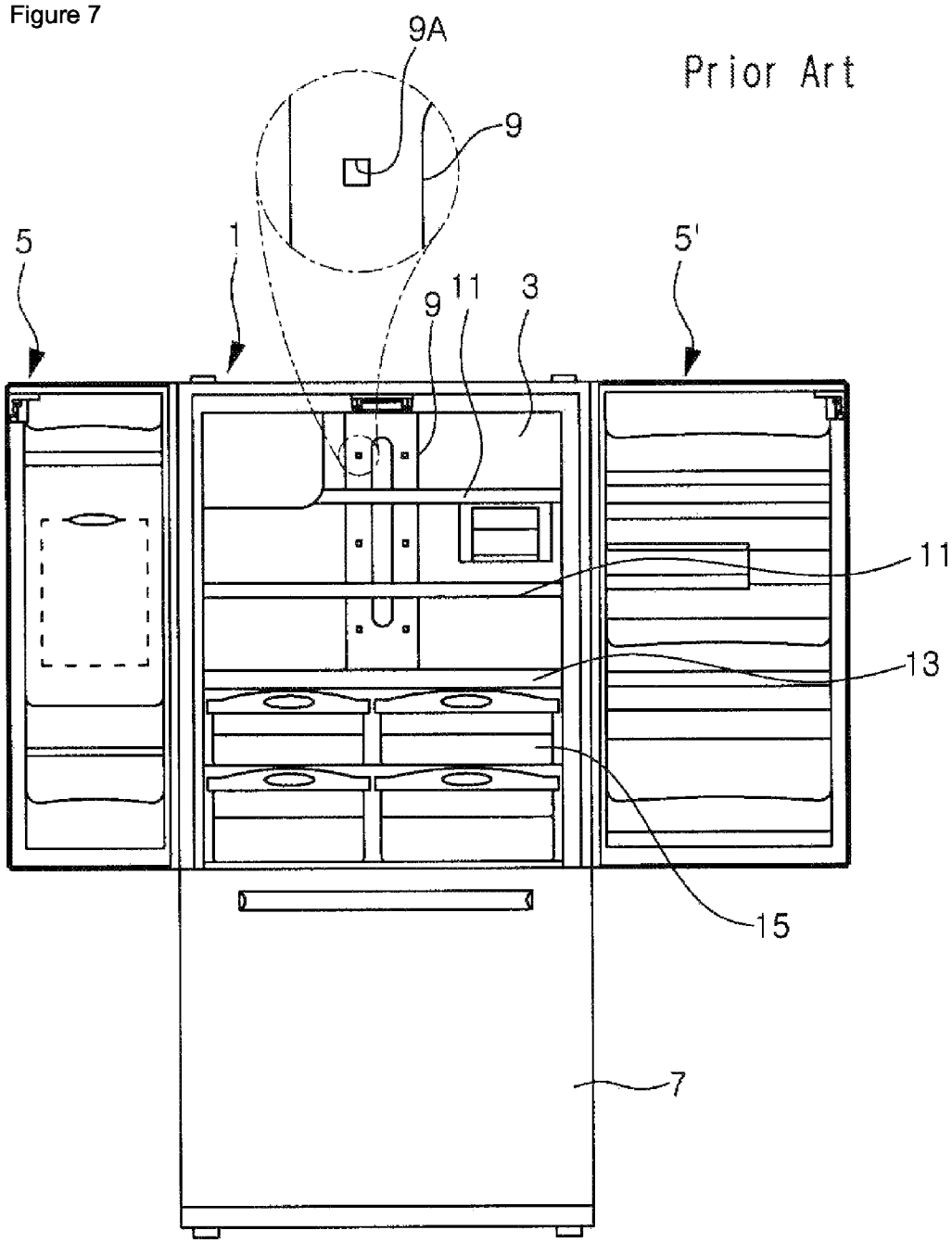
FIG. 7 is a front view showing an interior of a conventional refrigerator.

The refrigerating chamber 31 is selectively opened or closed by means of refrigerating chamber doors (not shown). The refrigerating chamber doors are installed to be pivotable on their one ends so that their leading ends are moved in a fore and aft direction. In addition, the freezing chamber is selectively opened or closed by means of a freezing chamber door (not shown). The freezing chamber door is configured to selectively open or close the freezing chamber in a drawer fashion. The configuration of the refrigerating chamber doors and the freezing chamber door is identical to that of the prior art shown in FIG. 7.

A cool air duct 33 is provided at a center of a rear surface of the refrigerating chamber 31. The cool air duct 33 is formed to vertically extend. In addition, a plurality of cool air supply holes 33A are formed in the cool air duct 33 to supply cool air of the freezing chamber to the refrigerating chamber 31. The cool air supply holes 33A function as inlets through which the cool air in the freezing chamber is supplied to the refrigerating chamber 31.

In addition, a plurality of cool air return holes (not shown) are provided in a lower portion of the rear surface of the refrigerating chamber 31. The cool air return holes are to transfer cool air, which has circulated in the refrigerating chamber 31, to a return duct (not shown). Also, the cool air transferred to the return duck through the cool air return holes flows to an evaporator, thereby allowing circulation of the cool air.

Meanwhile, a pair of support rails are provided on a lower portion of each of both side surfaces of the refrigerating chamber 31. The support rails are provided on both the side surfaces of the refrigerating chamber 31 to extend in a fore and aft direction. The support rails protrude in a direction to which portions of an inner case defining an interior of the refrigerating chamber 31 face each other.

Cover support rails 35, which are disposed at a relatively upper position among the support rails, serve to guide a vegetable receptacle cover 40, which will be described below, to be mounted and dismounted. Both ends of the vegetable receptacle cover 40 mounted to the refrigerating chamber 31 are supported on the cover support rails 35. In addition, casing support rails 37, which are disposed at a relatively lower position among the support rails, serve to guide receptacle casings 50, which will be described below, to move in or out. One ends of the receptacle casings 50 received in the refrigerating chamber 31 are respectively supported on the casing support rails 37 of the refrigerating chamber 31.

Support bushes 39 are respectively provided on both the side surfaces of the refrigerating chamber 31 at positions corresponding to front portions of the cover support rails 37. The support bushes 39 serve to guide the vegetable receptacle cover 40 to be supported by the cover support rails 35. Also, leading ends of both side ends of the bottom surface of the vegetable receptacle cover 40 are supported to the support bushes 39.

In addition, the vegetable receptacle cover 40 is provided in the lower portion of the refrigerating chamber 31. The vegetable receptacle cover 40 is detachably installed horizontally in the lower portion of the refrigerating chamber 31. The lowermost shelf among the shelves detachably installed in the refrigerating chamber 31 may function as the vegetable receptacle cover 40. The vegetable receptacle cover 40 is guided by means of the support bushes 39 and supported by the cover support rails 35 and the support bushes 39 of the refrigerating chamber 31.

As enlargedly shown in FIG. 15 an extension 41 is provided at the center of the bottom surface of the vegetable receptacle cover 40. The extension 41 is formed to protrude downward by a predetermined height from the center of the bottom surface of the vegetable receptacle cover 40 and to extend in the fore and aft direction. At this time, a leading end of the extension 41 is positioned at the same level as the casing support rails 37 of the refrigerating chamber 31.

The leading end of the extension 41 is provided with a pair of casing support rails 43. The casing support rails 43 of the vegetable receptacle cover 40 are to guide the receptacle casings 50 to be moved in or out. To this end, the casing support rails 43 of the vegetable receptacle cover 40 are positioned at the same level as the casing support rails 37 of the refrigerating chamber 31 for the vegetable receptacle cover 40. Also, the casing support rails 43 of the vegetable receptacle cover 40 are provided at the leading end of the extension 41 to extend in its longitudinal direction, and respectively protrude toward the casing support rails 37 of the refrigerating chamber 31 by a predetermined width. One ends of the respective receptacle casings 50 are supported on the casing support rails 37 of the refrigerating chamber 31 while the other ends thereof are supported on the casing support rails 43 of the vegetable receptacle cover 40.

In addition, a support protrusion 43A is provided on each of the casing support rails 43 of the vegetable receptacle cover 40. The support protrusion 43A is used for fixing the receptacle casing 50 received in the refrigerating chamber 31 at a predetermined position. The support protrusion 43A protrudes upward by a predetermined height from a front end of a floor surface of the casing support rail 43 of the vegetable receptacle cover 40.

Also, extension ribs 45 are provided at front ends of both side ends of the bottom surface of the vegetable receptacle cover 40. The extension ribs 45 extend downward by a height corresponding to the extension 41 from the front ends of both the side ends of the bottom surface of the vegetable receptacle cover 40. That is, leading ends of the extension ribs 45 are positioned at the same level as the casing support rails 37 of the refrigerating chamber 31.

In addition, an auxiliary rail 47 is provided on the leading end of each extension rib 45. The auxiliary rails 47 serve to substantially extend the length of the casing support rails 37 of the refrigerating chamber 31 in a fore and aft direction. To this end, the auxiliary rails 47 are respectively provided at the leading ends of the extension ribs 45 to extend in its longitudinal direction, and extend by a predetermined width in opposite directions in which they face each other.

Further, a support protrusion 47A is provided on each auxiliary rail 47 of the vegetable receptacle cover 40. The support protrusion 47A is used for fixing the receptacle casing 50 received in the refrigerating chamber 31 at a predetermined position. The support protrusion 47A protrudes upward by a predetermined height from a leading end of a floor surface of each auxiliary rail 47 of the vegetable receptacle cover 40.

Preferably, the vegetable receptacle cover 40, the extension 41, the casing support rails 43, the extension ribs 45 and the auxiliary rails 47 are substantially integrally formed. It is also possible that the extension 41 and casing support rails 43 and the extension rib 45 and auxiliary rail 47 are separately prepared and fixed to the bottom surface of the vegetable receptacle cover 40.

Meanwhile, a lower portion of the refrigerating chamber 31 partitioned by the vegetable receptacle cover 40 is generally referred to as a vegetable chamber. Also, a pair of receptacle casings 50 are installed in the vegetable chamber to be moved into or out of the vegetable chamber. Although the pair of receptacle casings 50 are installed to stand side by side in the vegetable chamber in this embodiment, there may be provided with more or less number of the receptacle casings.

A mounting space 50S is provided in each of the receptacle casings 50. A vegetable receptacle 60, which will be described below, is installed in the mounting space SOS of the receptacle casing 50 to be moved into or out of the mounting space 50S of the vegetable receptacle 60. The receptacle casing 50 serves to indirectly cool the food received in a receiving space 60S. As shown in FIG. 2, the receptacle casing 50 includes a lower casing 51, an upper casing 55, and an inner plate 57, wherein a channel 50P is provided in the receptacle casing 50.

The lower casing 51 is formed in the shape of a heptahedron with a front face and an upper portion generally opened to have surfaces corresponding to both side surfaces and bottom and rear surfaces of the vegetable receptacle 60. That is, the lower casing 51 substantially defines an external appearance of both side surfaces and bottom and rear surfaces of the receptacle casing 50.

Meanwhile, a contact flange 51A is provided on both side surfaces and a front end of the lower easing 51. The contact flange 51A extends in both lateral directions and in a downward direction from both the side surfaces and the front end, respectively. A front surface of the contact flange 51A is brought into contact with a rear surface of a catching flange 61 of the vegetable receptacle 60.

Support ribs 52A are respectively provided on a top end of both sides of the lower casing 51. The support ribs 52A are formed by bending upper portions of both the sides of the lower casing 51 outwardly. An edge portion of a bottom surface of the upper casing 52 is supported on upper surfaces of the support ribs 52A. Also, bottom surfaces of the support ribs 52A are slidably supported along the casing support rails 37 of the refrigerating chamber 31, the casing support rails 43 of the vegetable receptacle cover 40 and the auxiliary rails 47.

In addition, a plurality of guide protrusions 52B are provided on the upper surface of each support rib 52A. The guide protrusions 52B, each of which extends in the fore and aft direction, are provided on the upper surface of the support rib 52A to be spaced apart from each other by a predetermined interval. The guide protrusions 52B are used for guiding the upper casing 55 coupled to a top end of the lower casing 51. Both side ends of the upper casing 55 are respectively brought into contact with the opposite surfaces of the guide protrusions 52B.

A catching slot 52C is provided in each guide protrusion 52B. The catching slot 52C is formed in a '⊂' shape, which is opened to the front by cutting a lower portion of a front end of the guide protrusion 52B into a predetermined shape. The catching slot 52C is to fix the upper casing 55.

In addition, a support opening 52D is formed in an outer side of a front end of each support rib 52A. The support opening 52D is formed by partially cutting the outer side of the support rib 52A into a '⊂' shape opened to the outside. The support protrusions 43A and 47A of the casing support rail 43 of the vegetable receptacle cover 40 and the auxiliary rail 47 are respectively inserted into the support openings 52D.

Meanwhile, insertion slots 53A are respectively formed in top ends of both inner sides of the lower casing 51. The insertion slots 53A are opened in opposite directions in the top ends of both the inner sides of the lower casing 51. Both side ends of the inner plate 57 are inserted into the insertion slots 53A. Each of the insertion slots 53A is substantially formed between a pair of insertion ribs 53B and 53C that are provided to extend from the top ends of both the inner sides of the lower casing 51 in its longitudinal direction and to protrude in opposite directions.

In addition, support rollers 50R are respectively provided at central portions of front ends of both inner sides of the lower casing 51. Each of the support rollers 50R serves to guide a guide rib 63, which will be described below, when the vegetable receptacle 60 is moved into or out of the mounting space 50S.

Guide rails 54A and 54B are provided on both inner side surfaces of the lower casing 51 at positions corresponding to rears of the support rollers 50R. When the vegetable receptacle 60 is moved into or out of the mounting space 50S, the guide ribs 63 guided by the support rollers 50R slide along the guide rails.

The guide rails 54A and 54B consist of the upper guide rails 54A and the lower guide rails 54B. Thus, the guide ribs 63 substantially slide along spaces between the upper guide rails 54A and the lower guide rails 54B. The upper guide rails 54A and the lower guide rails 54B provided on both the inner side surfaces of the lower casing 51 to extend horizontally and to be vertically spaced apart from each other by a predetermined distance.

A plurality of reinforcing ribs 54C are provided on an upper surface of the upper guide rail 54A and a lower surface of the lower guide rail 54B. The reinforcing ribs 54C extend to be inclined upward or downward at a predetermined angle on the upper surface of the upper guide rail 54A and the upper surface of the lower guide rain 54B to serve to reinforce the upper guide rail 54A and the lower guide rain 54B, respectively.

In addition, an inclined guide section 54D is provided at a leading end of each upper guide rail 54A. The inclined guide sections 54D serve to guide the guide ribs 63 of the vegetable receptacle 60, which slide along the guide rails, into the spaces between the upper guide rails 54A and the lower guide rails 54B. To this end, the inclined guide sections 54D extend forward from the leading ends of the upper guide rails 54A to be inclined upward at a predetermined slope.

The upper casing 52 is placed on the top end of the lower casing 51, thereby defining an external appearance of an upper surface of the receptacle casing 50. The upper casing 52 is formed in the shape of a flat hexahedron with a lower portion opened.

A front surface 55A of the upper casing 55 perpendicularly extends downward from a front end of the upper surface of the upper casing 55. Also, a rear surface 55B of the upper casing 55 perpendicularly extends downward from a rear end of the upper surface of the upper casing 55. Lower ends of the front and rear surfaces 55A and 55B are respectively brought into contact with front and rear ends of the inner plate 57.

In addition, a cool air inlet 50I and a cool air outlet 50O are provided in the rear surface 55B of the upper casing 55. The cool air inlet 50I functions as an inlet for transferring cool air to the channel 50P through one of the cool air supply holes 33A. The cool air outlet 50O functions as an outlet for discharging cool air, which has flowed through the channel 50P, to the outside of the channel 50P, i.e., into the refrigerating chamber 31.

The cool air inlet 50I is formed at one end of the rear surface 55B of the upper casing 55 corresponding to the cool air supply hole 33A. That is, in case of the receptacle casing 50 positioned at the left side in FIG. 1, the cool air inlet 50I is formed at the right side end of the rear surface 55B of the upper casing 55 in the drawing. In addition, in case of the receptacle casing 50' positioned at the right side in FIG. 1, the cool air inlet is formed at the left side end of the rear surface of the upper casing in the drawing.

Further, the cool air outlet 50O is provided at the other side end of the rear surface 55B of the upper casing, which corresponds to the side opposite to the cool air inlet 50I so as to maximize a distance from the cool air inlet 50I to the cool air outlet 50O. That is, in case of the receptacle casing 50 positioned at the left side in FIG. 1, the cool air outlet 50O is formed at the left side end of the rear surface 55B of the upper casing 55. In addition, in case of the receptacle casing 50' positioned at the right side in FIG. 1, the cool air outlet 50O is formed at a right side end of the rear surface of the upper casing in the drawing.

A plurality of catching protrusions 55C are provided on each of both side ends of the upper casing 55. The catching protrusions 55C extend outward by a predetermined length from both side ends of the upper casing 55. The catching protrusions 55C are respectively inserted into the catching slots 52C while the upper casing 55 is placed on the top end of the lower casing 51.

The inner plate 53 is horizontally installed to the top end of the lower casing 51, which corresponds to an interior of the mounting space 50S. The inner plate 53 is formed in the shape of a rectangular plate. In addition, both the side ends of the inner plate 57 slides along the insertion slots 53A in a state where both the side ends are inserted into the insertion slots 53A.

Substantially, the channel 50P is defined by the upper surface and both the side surfaces of the upper casing 55 and the upper surface of the inner plate 57. In addition, cool air is transferred to the channel 50P through the cool air inlet 50I, and the cool air flowing in the channel 50P is transferred to the interior of the refrigerating chamber 31 through the cool air outlet 50O.

In addition, a cool air guide 58 is provided on the upper surface of the inner plate 57. The cool air guide 58 serves to guide the cool air transferred to an interior of the channel 58B through the cool air inlet 50I to flow in the channel 50P and then be directed to the cool air outlet 50O. The cool air guide 58 is substantially formed integrally with the inner plate 57.

The cool air guide 58, which is defined by a pair of members, includes a first guide section 58A, a second guide section 58B and a third guide section 58C, thereby being formed in a '⊂' shape generally opened rearwards on the upper surface of the inner plate 57. At this time, rear ends of the first guide section 58A and the second guide section 58B corresponding to both ends of the cool air guide 58 extend rearward at the rear end of the inner plate 57 to pass through the cool air inlet 50I and the cool air outlet 50O.

The first guide section 58A is provided on one of both sides of the upper surface of the inner plate 57 to extend in the fore and aft direction. The rear end of the first guide section 58A is connected to an inner top end of the lower casing 51 corresponding to both side ends of the cool air inlet 50I. The second guide section 58B is provided on the front end of the upper surface of the inner plate 57 to extend from side to side. In addition, one end of the second guide section 58B is connected to a front end of the first guide section 58A. The third guide section 58C is provided on the other side of the upper surface of the inner plate 57 to extend in the fore and aft direction, which corresponds to the other side of the first guide section 58A. A front end of the third guide section 58C is connected to the other end of the second guide section 58B. In addition, the rear end of the third guide section 58C is connected to the inner top end of the lower casing 51 corresponding to both side ends of the cool air outlet 50.

Meanwhile, referring to FIG. 1 again, the vegetable receptacle 60 is installed to the mounting space 50S to be movable into or out of the mounting space 50S. The vegetable receptacle 60 is formed in the form of a hexahedron having an upper portion opened. In addition, a predetermined receiving space OS is provided in the vegetable receptacle 60. Food such as vegetable or fruit is received in the receiving space 60S of the vegetable receptacle 60.

In addition, the catching flange 61 is provided on a front edge portion of the vegetable receptacle 60. When the vegetable receptacle 60 is mounted to the mounting space 50S, the rear surface of the catching flange 61 is brought into contact with the contact flange 51A, thereby preventing the vegetable receptacle 60 from being fully mounted into the interior of the mounting space 50S.

The guide ribs 63 are respectively provided on both outer side surfaces of the vegetable receptacle 60. The guide ribs 63 are formed to protrude outward by a predetermined length from both the side surfaces of the vegetable receptacle 60 and to extend horizontally. In addition, a vertical height of each guide rib 63 is set smaller than the interval between the upper guide rail 54A and the lower guide rail 54B. While the vegetable receptacle 60 is moved into or out of the mounting space 50S, the guide rib 63 is guided by the support roller 50R and then slides along the space between the upper guide rail 54A and the lower guide rail 54B.

Hereinafter, the operation of a preferred embodiment of the cool air supply structure of a storage receptacle for a refrigerator according to the present invention will be described in more detail.

First, in the preferred embodiment of the cool air supply structure of a storage receptacle for a refrigerator according to the present invention, a process of mounting the vegetable receptacle into the receptacle casing will be explained with reference to the accompanying drawings.

Figure 5:
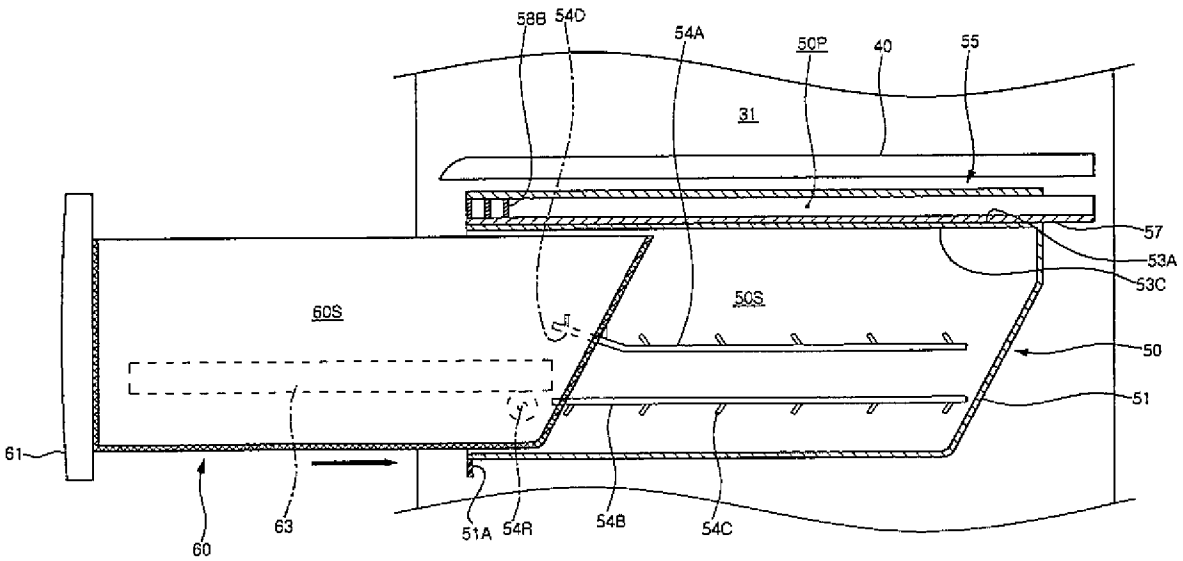
FIG. 5 is a view illustrating a process of mounting a vegetable receptacle to the receptacle casing according to the preferred embodiment of the present invention.

FIG. 5 is a view illustrating a process of mounting a vegetable receptacle to the receptacle casing according to the preferred embodiment of the present invention.

As shown in the figure, the vegetable receptacle 60 is moved to the right side in the drawing toward the interior of the receiving space 50S of the receptacle casing 50. Thus, the vegetable receptacle 60 is mounted to the mounting space 50S of the receptacle casing 50 in such a manner that the rear end of the vegetable receptacle 60 starts to be mounted. At this time, the guide rib 63 of the vegetable receptacle 60 is guided to the guide rail, more specifically into the space between the upper guide rail 54A and the lower guide rail 54B, by means of the support roller 54R of the receptacle casing 50.

In addition, the guide rib 63 is guided into the space between the upper guide rail 54A and the lower guide rail 54B by the inclined guide section 54D of the upper guide rail 54A. Thus, although the storage receptacle 60 moves toward the interior of the mounting space 50S of the receptacle casing 50 to a position where the guide rib 63 does not exactly match with the space between the upper guide rail 54A and the lower guide rail 54D, the guide rib 63 is guided into the space between the upper guide rail 54A and the lower guide rail 54B by means of the inclined guide section 54D, thereby preventing the storage receptacle 60 from being erroneously mounted into the mounting space 50S of the receptacle casing 50.

Meanwhile, if the vegetable receptacle 60 is continuously moved into the mounting space 50S of the receptacle casing 50, i.e., to the right side in the drawing, the guide rib 63 slides along the guide rail. Then, as shown in FIG. 4, if the vegetable receptacle 60 is mounted into the mounting space 50S of the receptacle casing 50, the rear surface of the catching flange 61 of the vegetable receptacle 60 is brought into contact with the front surface of the contact flange 51A of the receptacle casing 50. Thus, the vegetable receptacle 60 does not fully enter the mounting space 50S of the receptacle casing 50.

Now, a state where cool air flows in the preferred embodiment of the cool air supply structure of a storage receptacle for a refrigerator according to the present invention will be explained with reference to the accompanying drawings.

Figure 6:
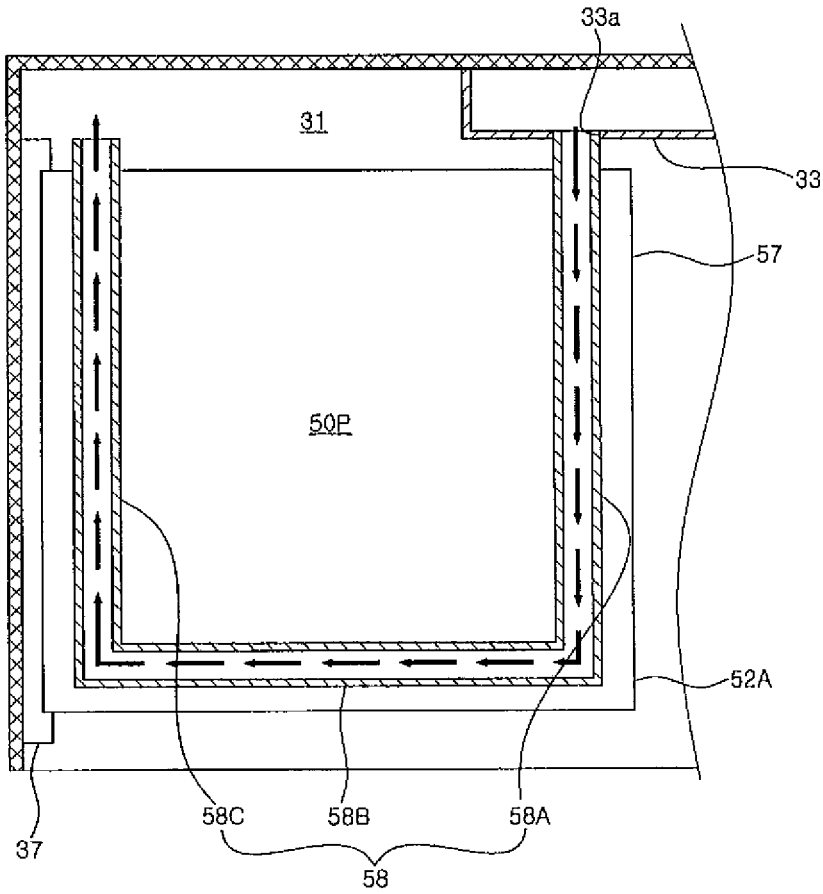
FIG. 6 is a plane view showing that cool air flows through a channel in the embodiment of the present invention.

FIG. 6 is a plane view showing that cool air flows through a channel in the embodiment of the present invention.

As shown in the figure, the cool air supplied from the cool air supply hole 33A of the cool air duct 33, i.e., the cool air in the freezing chamber, is transferred into the channel 50P through the cool air inlet 50I. The cool air transferred into the channel 50P flows in the channel 50P, and is then discharged out of the channel 50P through the cool air outlet 50O.

At this time, the cool air transferred into the channel 50P is guided by means of the cool air guide 58. That is, the cool air transferred into the channel 50P through the cool air inlet 50I is guided by means of the first guide section 58A of the cool air guide 58 to flow toward the right front end of the channel 50P in the drawing, and is then guided by means of the second guide section 58B of the cool air guide 58 to flow from the right front end to the left front end of the channel 50P in the drawing. In addition, the cool air guided by means of the second guide section 58B to flow toward the left front end of the channel 50P in the figure is guided by means of the third guide section 58C of the cool air guide 58 to flow toward the left rear end of the channel 50P in the drawing, i.e., toward the cool air outlet 50O.

The cool air flowing toward the cool air outlet 50O as mentioned above is discharged out of the channel 50P through the cool air outlet 50O, i.e., into the refrigerating chamber 31. In addition the cool air is transferred to an evaporator through the cool air return hole of the refrigerating chamber 31.

Meanwhile, the food received in the receiving space 60S of the vegetable receptacle 60 mounted to the mounting space 50S of the receptacle casing 50 is indirectly cooled by the cool air flowing in the channel 50P. Thus, it is possible to prevent the food received in the receiving space 60S of the storage receptacle 60 from being soaked with smell of other food stored in the refrigerating chamber 31 and from being weakly cooled or overcooled, or to prevent moisture of food from being vaporized.

It will be apparent that those skilled in the art can make various other modifications thereto within the scope of the technical spirit of the invention, and the true scope of the present invention should be interpreted on the basis of the appended claims.

INDUSTRIAL APPLICABILITY

According to the cool air supply structure of a storage receptacle for a refrigerator of the present invention so configured, the following advantages can be expected.

According to the present invention, food received in the storage receptacle is indirectly cooled by cool air flowing in the channel provided in the receptacle casing. Thus, it is possible to prevent smell of other food stored in the refrigerating chamber from being soaked into the food received in the storage receptacle, to prevent moisture of the food from being vaporized, and also, to prevent the food from being weakly cooled or overcooled, whereby the food received in the storage receptacle can be kept more fresh for a long time.

In addition, in the present invention, the cool air supply hole for supplying the cool air to the refrigerating chamber directly communicates with the cool air inlet of the channel. Thus, there is no need for an additional configuration for supplying cool air to the channel, and thus, the food received in the storage receptacle can be kept fresh in a simpler way.

Further, in the present invention, the cool air guide for guiding cool air is provided in the channel. Thus, the cool air supplied into the channel flows uniformly in the channel by means of the cool air guide, thereby indirectly cooling the food received in the storage receptacle in a more efficient way.

The invention claimed is:

1. A cool air supply structure of a storage receptacle for a refrigerator, the refrigerator including a main body having a storage space provided therein and a door for selectively opening or closing the storage space, the cool air supply structure comprising:

at least one receptacle casing detachably installed into the storage space, the at least one receptacle casing having a mounting space provided therein for allowing a storage receptacle to be movable into and out of the mounting space, the at least one receptacle casing being defined by an upper casing and a lower casing; and a channel provided in the at least one receptacle casing so that cool air flows in the channel, wherein the lower casing is free of the channel for cooling air, wherein the receptacle casing includes the lower casing formed in the shape of a box with a front face and an upper portion opened, the upper casing formed in the shape of a box with a lower portion opened and fixed to a top end of the lower casing, and an inner plate fixed to an interior of the lower casing corresponding to a lower portion of the upper casing, wherein the channel is defined by an upper surface and both side surfaces of the upper casing and an upper surface of the inner plate, and wherein insertion slots are respectively provided in top ends of both inner sides of the lower casing to extend in a fore and aft direction, each insertion slot projecting out from a surface of each corresponding inner side, and both side ends of the inner plate are inserted into the insertion slots, whereby the lower casing and the inner plate are fixed to each other.

2. The cool air supply structure as claimed in claim 1, further comprising a storage receptacle located in the mounting space to be moved into and out of the mounting space, the storage receptacle having a receiving space defined therein to store food, wherein food received in the storage receptacle is indirectly cooled by the cool air flowing in the channel.

3. The cool air supply structure as claimed in claim 1, further comprising a cool air guide for guiding the cool air flowing in the channel.

4. The cool air supply structure as claimed in claim 3, wherein the cool air guide guides the cool air introduced into the channel to flow in a front end portion of the channel and be discharged out of the channel.

5. The cool air supply structure as claimed in claim 4, wherein the cool air guide extends toward the outside of the channel to pass through a cool air inlet and a cool air outlet provided in the rear surface of the receptacle casing.

6. The cool air supply structure as claimed in claim 1, wherein the front face includes an opening.

7. The cool air supply structure as claimed in claim 6, further comprising a cool air guide for guiding the cool air flowing in the channel.

8. The cool air supply structure as claimed in claim 7, wherein the cool air guide is formed integrally with the upper surface of the inner plate, whereby a top end of the cool air guide is brought into contact with an inside upper surface of the upper casing.

9. The cool air supply structure as claimed in claim 8, wherein the cool air guide guides the cool air introduced into the channel to flow in a front end portion of the channel and then to be discharged out of the channel.

10. The cool air supply structure as claimed in claim 9, wherein the cool air guide extends to pass through a cool air inlet and a cool air outlet provided in the rear surface of the receptacle casing.

11. The cool air supply structure as claimed in claim 6, wherein at least one catching slot is provided in any one of the lower casing and the upper casing, at least one catching protrusion is provided on the other one of the lower casing and the upper casing, and the catching protrusion is inserted into the catching slot in a state where the upper casing is placed on the top end of the lower casing, whereby the lower casing and the upper casing are fixed to each other.

12. The cool air supply structure as claimed in claim 11, wherein the catching slot is formed by cutting a portion of at least one guide protrusion provided on the top end of the lower casing to be opened rearwards, and the catching protrusion extends outward from each of both side ends of the upper casing.

13. The cool air supply structure as claimed in claim 1, further comprising a guide means for guiding the storage receptacle that is moved into or out of the mounting space.

14. The cool air supply structure as claimed in claim 13, wherein the guide means includes:

support rollers respectively provided at front ends of both inner sides of the at least one receptacle casing to guide movement of guide ribs provided on both outer side surfaces of the storage receptacle while the storage receptacle is moved into or out of the mounting space; and guide rails respectively provided on both inner side surfaces of the at least one receptacle casing at positions corresponding to rears of the support rollers so that the guide ribs guided by means of the support rollers slide thereon.

15. The cool air supply structure as claimed in claim 14, wherein the guide rails include:

upper guide rails horizontally extending on both the inner side surfaces of the at least one receptacle casing; and lower guide rails horizontally extending on both the inner side surfaces of the at least one receptacle casing to be downwardly spaced apart from bottom surfaces of the upper guide rails.

16. The cool air supply structure as claimed in claim 15, wherein the guide rail further includes an inclined guide section extending forward from a leading end of the upper guide rail to be inclined upward to guide sliding of the guide rib while the storage receptacle is received in the mounting space.

17. The cool air supply structure as claimed in claim 16, wherein the guide rail further includes at least one reinforcing rib provided on an upper surface of the upper guide rail and a lower surface of the lower guide rail to reinforce the upper and lower guide rails.

18. A refrigerator comprising:

a main body having a storage space provided therein, the storage space including a freezing chamber and a refrigerating chamber;

a door to selectively open and close the storage space;

a cool air duct provided in a center of a rear portion of the refrigerating chamber to transfer cool air to the refrigerating chamber, the cool air duct including one or more cool air supply holes functioning as an inlet for transferring the cool air to the refrigerating chamber;

at least one receptacle casing having a mounting space provided therein, the at least one receptacle casing being defined by an upper casing, an inner plate and a lower casing, the lower casing having a top opening and a front opening, the inner plate including a rim, and the upper casing being assembled to the lower casing;

an insertion slot provided at an edge portion of a top portion of the lower casing, the rim of the inner plate being detachably inserted into the insertion slot, a channel provided between the inner plate and the upper casing, the channel having a cool air inlet connected to one of the cool air supply holes and a cool air outlet opened toward the refrigerating chamber, the cool air being supplied from the cool air duct and returned to the refrigerating chamber after passing through the channel;

a storage receptacle located in the mounting space to be moved into and out of the mounting space, the storage receptacle having a receiving space defined therein to store food; and a receptacle cover supporting the at least one receptacle casing, the receptacle cover being detachably mounted on a side wall of the refrigerating chamber.

19. The refrigerator as claimed in claim 18, wherein the at least one receptacle casing includes a pair of receptacle casings arranged side by side in the refrigerating chamber.

20. The refrigerator as claimed in claim 18, wherein the cool air flowing in the channel is introduced through a cool air inlet provided in a rear surface of the at least one receptacle casing, and the cool air flowing in the channel is discharged to the refrigerating chamber through a cool air outlet provided in the rear surface of the at least one receptacle casing.

21. The refrigerator as claimed in claim 18, wherein support ribs are respectively provided on top ends of both sides of the receptacle casing, the support ribs being slidably supported along rails provided on both side surfaces of the storage space.

22. The refrigerator as claimed in claim 21, wherein the rails include:

casing support rails provided on a center of a bottom surface of a shelf detachably installed to be moved into or out of the storage space;

casing support rails provided on both the side surfaces of the storage space; and auxiliary rails provided on both side ends of the bottom surface of the shelf at the same level as the casing support rails of the storage space to extend the casing support rail of the storage space.

23. The refrigerator as claimed in claim 22, further comprising a fixing means for fixing the at least one receptacle casing to prevent the at least one receptacle casing from being detached inadvertently in a state where the at least one receptacle casing is mounted into the storage space.

24. The refrigerator as claimed in claim 23, wherein the fixing means includes:

a fixing protrusion provided on any one of the casing support rail and the at least one receptacle casing; and a fixing opening provided in the other one of the casing support rail and the at least one receptacle casing, wherein the fixing protrusion is inserted into the fixing opening, whereby the at least one receptacle casing is fixed in a state where the at least one receptacle casing is received in the storage space.

25. The refrigerator as claimed in claim 18, wherein the channel is formed along with an edge portion on an upper surface of the inner plate.

26. The refrigerator as claimed in claim 24, wherein the channel has a middle portion extending across a front edge portion of the inner plate.

27. The refrigerator as claimed in claim 18, wherein the channel has a pair of parallel longitudinal walls provided on an upper surface of the inner plate, and wherein the upper casing contacts a top portion of the walls when the insertion plate is inserted into the insertion slot.

28. The refrigerator as claimed in claim 18, wherein the cool air outlet is located at a rear portion of the refrigerator.

* * * * *